US009617870B2

(12) United States Patent
Chokshi

(10) Patent No.: US 9,617,870 B2
(45) Date of Patent: Apr. 11, 2017

(54) BRACKET FOR MOUNTING A STATOR GUIDE VANE ARRANGEMENT TO A STRUT IN A TURBINE ENGINE

(71) Applicant: United Technologies Corporation, Hartford, CT (US)

(72) Inventor: Jaisukhlal V. Chokshi, Palm Beach Gardens, FL (US)

(73) Assignee: United Technologies Corporation, Farmington, CT (US)

( * ) Notice: Subject to any disclaimer, the term of this patent is extended or adjusted under 35 U.S.C. 154(b) by 518 days.

(21) Appl. No.: 14/172,255

(22) Filed: Feb. 4, 2014

(65) Prior Publication Data

US 2015/0125291 A1 May 7, 2015

Related U.S. Application Data

(60) Provisional application No. 61/761,008, filed on Feb. 5, 2013.

(51) Int. Cl.
*F01D 25/16* (2006.01)
*F01D 9/06* (2006.01)

(52) U.S. Cl.
CPC ..... *F01D 25/162* (2013.01); *F01D 9/065* (2013.01)

(58) Field of Classification Search
CPC ..... F05D 2240/14
USPC ..... 415/142
See application file for complete search history.

(56) References Cited

U.S. PATENT DOCUMENTS

| | | | | |
|---|---|---|---|---|
| 2,938,336 | A * | 5/1960 | Peterson | F01D 9/065 60/39.5 |
| 4,369,016 | A | 1/1983 | Dennison | |
| 4,478,551 | A | 10/1984 | Honeycutt, Jr. et al. | |
| 7,797,946 | B2 | 9/2010 | Kumar et al. | |
| 7,815,417 | B2 | 10/2010 | Somanath et al. | |
| 8,061,980 | B2 | 11/2011 | Praisner et al. | |
| 8,113,768 | B2 | 2/2012 | Somanath et al. | |
| 8,616,835 | B2 * | 12/2013 | Hashimoto | F01D 9/065 415/142 |
| 2010/0303610 | A1 | 12/2010 | Wang et al. | |
| 2011/0123322 | A1 | 5/2011 | Allen-Bradley et al. | |
| 2012/0107124 | A1 | 5/2012 | Farah et al. | |
| 2013/0000310 | A1 | 1/2013 | Chokshi et al. | |

* cited by examiner

*Primary Examiner* — Craig Kim
*Assistant Examiner* — Jason Davis
(74) *Attorney, Agent, or Firm* — O'Shea Getz P.C.

(57) ABSTRACT

A turbine engine assembly, with an axis, includes a vane arrangement segment, a mounting bracket and a strut. The vane arrangement segment includes a first platform segment, a second platform segment and a guide vane that extends radially between and is connected to the first and the second platform segments. The mounting bracket is connected to the vane arrangement segment. The strut extends radially through the first platform segment, the second platform segment and the guide vane, and is engaged with the mounting bracket. The mounting bracket attaches the vane arrangement segment to the strut.

19 Claims, 6 Drawing Sheets

BRACKET FOR MOUNTING A STATOR GUIDE VANE ARRANGEMENT TO A STRUT IN A TURBINE ENGINE

This application claims priority to U.S. Patent Appln. No. 61/761,008 filed Feb. 5, 2013.

BACKGROUND OF THE INVENTION

1. Technical Field

This disclosure relates generally to a turbine engine and, more particularly, to mounting a stator guide vane arrangement within a turbine engine.

2. Background Information

A typical turbine engine includes a fan section, a compressor section, a combustor section and a turbine section. The turbine engine may also include a stator guide vane arrangement that guides a flow of core gas within the turbine section.

A typical stator guide vane arrangement includes a plurality of guide vanes that extend radially between an inner platform and an outer platform. The vane arrangement is mounted to and located within a turbine engine case using a plurality of pins. The pins extend radially inwards through the engine case, and mate with bosses on the outer platform. A plurality of outer bushings may be respectively arranged between the pins and the engine case. A plurality of inner bushings may be respectively arranged between the pins and the bosses. Such pin, boss and bushing connections may increase the weight of the vane arrangement and the engine. The pin, boss and bushing connections may also increase the complexity and cost to manufacture the vane arrangement.

SUMMARY OF THE DISCLOSURE

According to an aspect of the invention, a turbine engine assembly with an axis is provided that includes a vane arrangement segment, a mounting bracket and a strut. The vane arrangement segment includes a first platform segment, a second platform segment and a guide vane that extends radially between and is connected to the first and the second platform segments. The mounting bracket is connected to the vane arrangement segment. The strut extends radially through the first platform segment, the second platform segment and the guide vane, and is engaged with the mounting bracket. The mounting bracket attaches the vane arrangement segment to the strut.

According to another aspect of the invention, a turbine engine assembly is provided that includes a vane arrangement segment and a mounting bracket. The vane arrangement segment includes a first platform segment, a second platform segment, a guide vane and a cavity. The guide vane extends along a guide vane axis between the first and the second platform segments. The guide vane is connected to the first and the second platform segments. The cavity extends along the guide vane axis through the first platform segment, the second platform segment and the guide vane. The mounting bracket includes a leg and a sleeve. The leg connects the sleeve to the vane arrangement segment. The sleeve includes a bore that extends along the guide vane axis.

According to still another aspect of the invention, a turbine engine assembly is provided that includes a guide vane arrangement, a mounting bracket and a strut. The guide vane arrangement includes a first platform, a second platform and a plurality of guide vanes arranged circumferentially around an axis. The guide vanes include a first guide vane that extends radially between and is connected to the first platform and the second platform. The mounting bracket is connected to the guide vane arrangement. The strut extends radially through the first platform, the second platform and the first guide vane, and is engaged with the mounting bracket. The mounting bracket attaches the guide vane arrangement to the strut.

The assembly may include a second mounting bracket that is connected to the guide vane arrangement. The assembly may also or alternatively include a second strut that extends radially through the first platform, the second platform and a second guide vane included in the guide vanes. The second strut may be engaged with the second mounting bracket. The second mounting bracket may attach the guide vane arrangement to the second strut.

The assembly may include a strut that extends through the first platform segment, the second platform segment and the guide vane. The strut may be engaged with the sleeve. The mounting bracket may attach the vane arrangement segment to the strut.

The mounting bracket may structurally couple the vane arrangement segment to the strut. The mounting bracket may also or alternatively constrain at least axial and lateral (e.g., circumferential and/or tangential) movement of the vane arrangement segment relative to the strut. The mounting bracket may also or alternatively be slidably engaged with the strut along an axis of the guide vane.

The vane arrangement segment may extend radially between an inner side and an outer side. The mounting bracket may be located at the outer side, or the inner side.

The mounting bracket may be connected to the second platform segment, or the first platform segment.

The mounting bracket includes a sleeve and a leg. The leg may connect the sleeve to the vane arrangement segment. The strut may extend radially through and be engaged with the sleeve. The leg may be one of a plurality of legs that each connects the sleeve to the vane arrangement segment.

The leg may include a (e.g., longitudinal) first portion and a (e.g., longitudinal) second portion. The first portion may be arranged laterally between the vane arrangement segment and the second portion. The first portion may have a chord that is angled relative to a chord of the second portion.

The strut may be configured as or otherwise include a tie rod.

The assembly may include an engine component and an engine case. The strut may structurally couple and/or transfers radial loads between the engine component and the engine case.

The assembly may include a bushing that is arranged between the strut and the mounting bracket.

The foregoing features and the operation of the invention will become more apparent in light of the following description and the accompanying drawings.

DETAILED DESCRIPTION OF THE INVENTION

Figure 1:
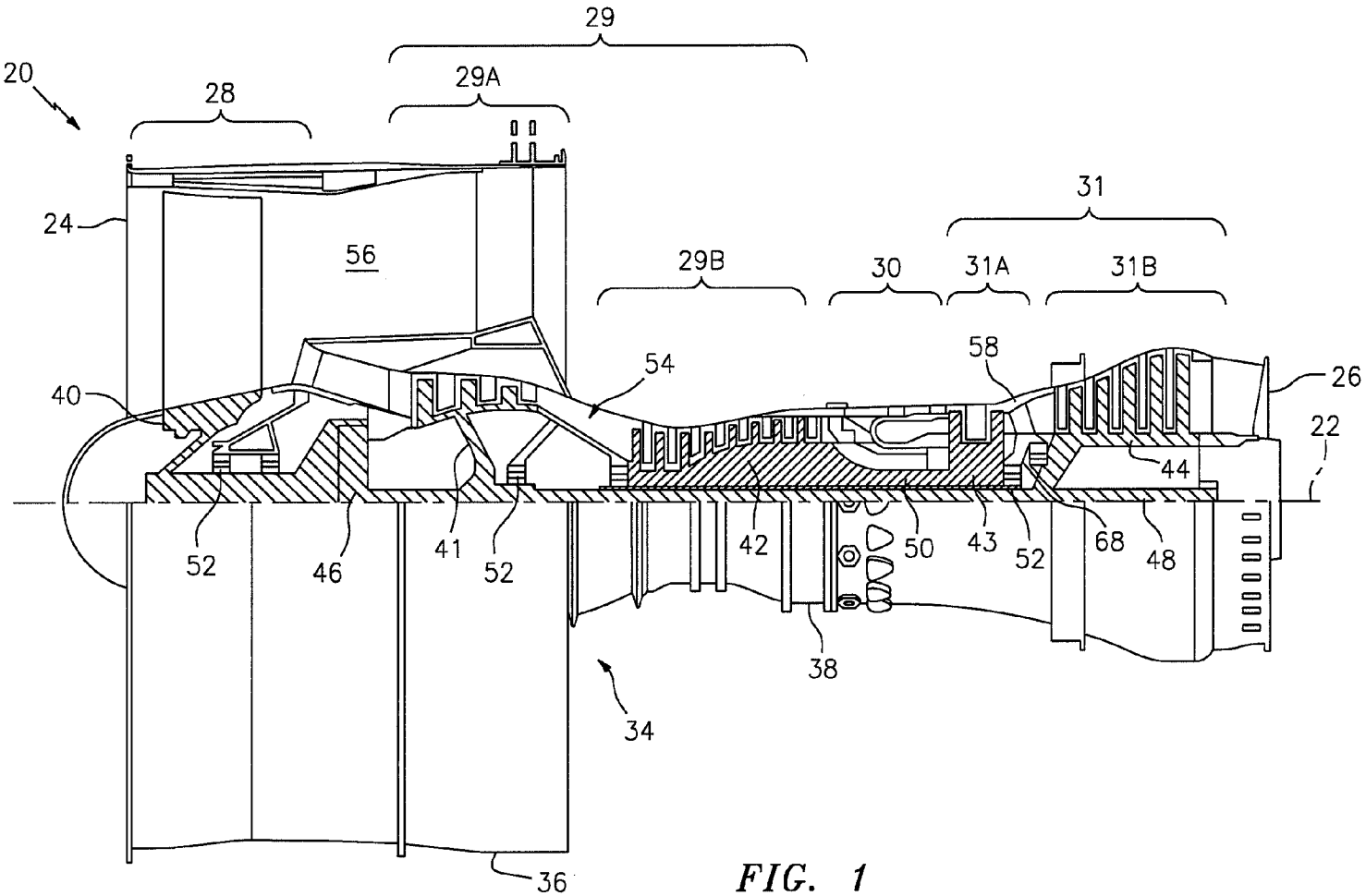
FIG. 1 is a side cutaway illustration of a geared turbine engine.

FIG. 1 is a side cutaway illustration of a geared turbine engine 20 that extends along an engine axis 22 between an upstream airflow inlet 24 and a downstream airflow exhaust 26. The engine 20 includes a fan section 28, a compressor section 29, a combustor section 30 and a turbine section 31. The compressor section 29 includes a low pressure compressor (LPC) section 29A and a high pressure compressor (HPC) section 29B. The turbine section 31 includes a high pressure turbine (HPT) section 31A and a low pressure turbine (LPT) section 31B. The engine sections 28-31 are arranged sequentially along the axis 22 within an engine housing 34, which includes a first engine case 36 (e.g., a fan nacelle) and a second engine case 38 (e.g., a core nacelle).

Each of the engine sections 28, 29A, 29B, 31A and 31B includes a respective rotor 40-44. Each of the rotors 40-44 includes a plurality of rotor blades arranged circumferentially around and connected to (e.g., formed integral with or mechanically fastened, welded, brazed, adhered or otherwise bonded to) one or more respective rotor disks. The fan rotor 40 is connected to a gear train 46; e.g., an epicyclic gear train. The gear train 46 and the LPC rotor 41 are connected to and driven by the LPT rotor 44 through a low speed shaft 48. The HPC rotor 42 is connected to and driven by the HPT rotor 43 through a high speed shaft 50. The low and high speed shafts 48 and 50 are rotatably supported by a plurality of bearings 52. Each of the bearings 52 is connected to the second engine case 38 by at least one stator such as, for example, an annular support strut.

Air enters the engine 20 through the airflow inlet 24, and is directed through the fan section 28 and into an annular core gas path 54 and an annular bypass gas path 56. The air within the core gas path 54 may be referred to as "core air". The air within the bypass gas path 56 may be referred to as "bypass air". The core air is directed through the engine sections 29-31 and exits the engine 20 through the airflow exhaust 26. Within the combustor section 30, fuel is injected into and mixed with the core air and ignited to provide forward engine thrust. The bypass air is directed through the bypass gas path 56 and out of the engine 20 to provide additional forward engine thrust, or reverse thrust via a thrust reverser.

Figure 2:
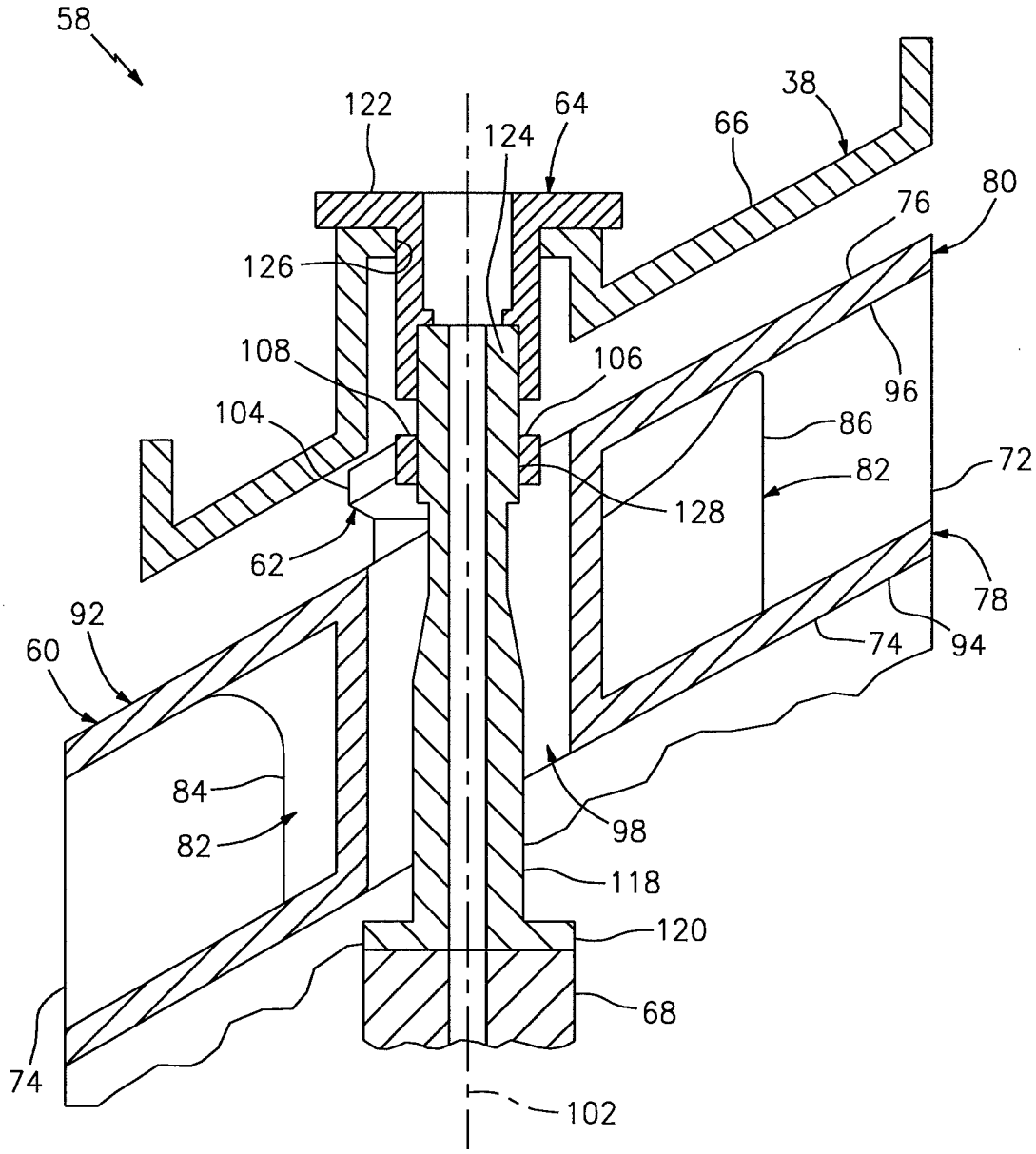
FIG. 2 is a partial side-sectional illustration of a turbine engine assembly for the engine of FIG. 1.

FIG. 2 is a partial side-sectional illustration of a turbine engine assembly 58 for the engine 20 of FIG. 1. The assembly 58 is configured as a mid-turbine frame. Referring to FIG. 1, for example, the assembly 58 guides the flow of core air between the HPT rotor 43 and the LPT rotor 44. The assembly 58 also structurally supports one or more of the bearings 52 and, thus, one or more of the shafts 48 and 50.

Referring to FIG. 2, the assembly 58 includes a stator guide vane arrangement 60, one or more mounting brackets 62, and one or more support struts 64. The assembly 58 also includes at least a portion 66 (e.g., an axial segment) of the second engine case 38 and an engine component 68 such as, for example, a stator that supports the bearings 52 located between the HPT rotor 43 and the LPT rotor 44 (see FIG. 1).

Figure 3:
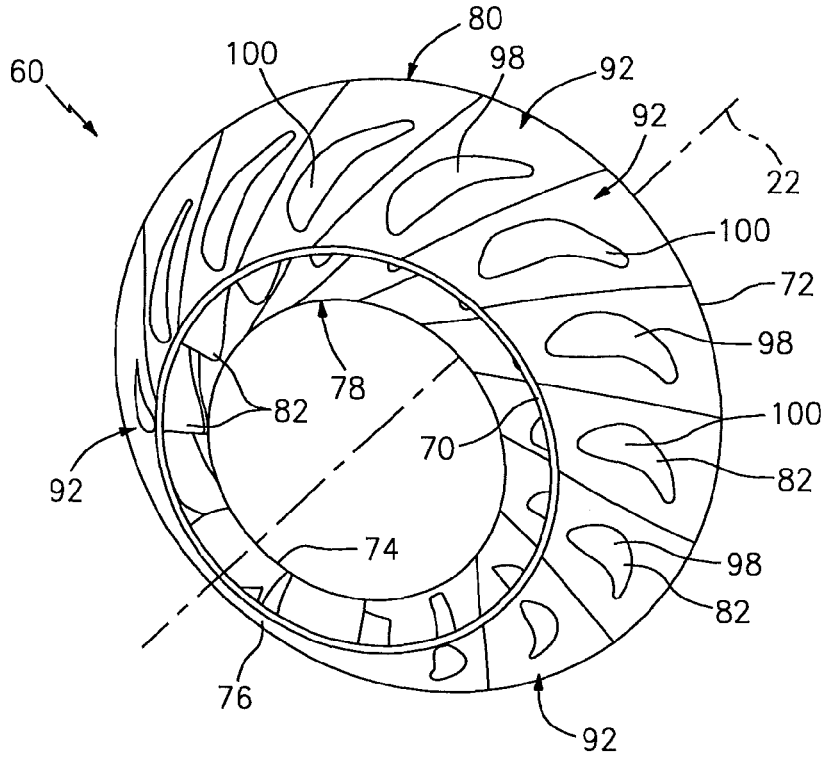
FIG. 3 is a perspective illustration of a stator guide vane arrangement.
Figure 4:
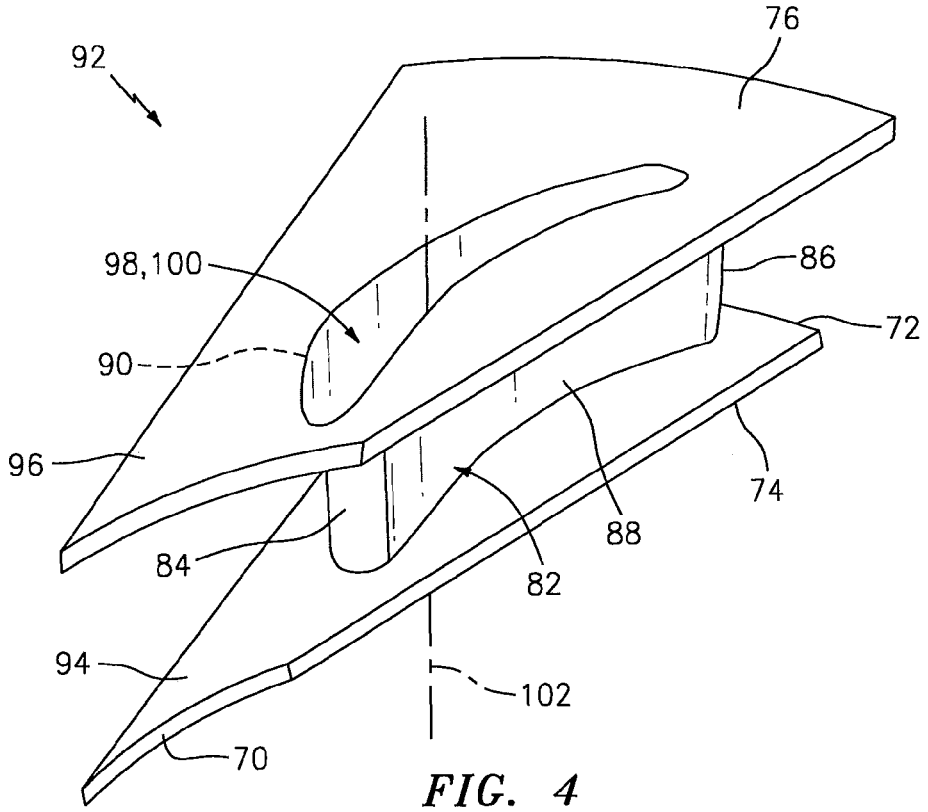
FIG. 4 is a perspective illustration of a vane arrangement segment included in the vane arrangement of FIG. 3.

Referring to FIG. 3, the vane arrangement 60 extends axially between an upstream end 70 and a downstream end 72. The vane arrangement 60 extends radially from an arrangement inner side 74 to an arrangement outer side 76. The vane arrangement 60 includes a (e.g., annular) inner platform 78, a (e.g., annular) outer platform 80, and one or more hollow stator guide vanes 82. The inner platform 78 extends circumferentially around the axis 22. The outer platform 80 extends circumferentially around the axis 22 and the inner platform 78. The guide vanes 82 are arranged circumferentially around the axis 22. The guide vanes 82 extend radially between and are connected to the inner platform 78 and the outer platform 80. Referring to FIG. 4, one or more of the guide vanes 82 each extends axially between a leading edge 84 and a training edge 86. One or more of the guide vanes 82 each extends laterally (e.g., circumferentially or tangentially) between a concave surface 88 and a convex surface 90.

Referring to FIG. 3, the vane arrangement 60 is configured from a plurality of vane arrangement segments 92. Referring to FIG. 4, one or more of the vane arrangement segments 92 each includes a (e.g., circumferential) segment 94 of the inner platform 78, a (e.g., circumferential) segment 96 of the outer platform 80, at least one of the guide vanes 82, and at least one cavity 98, 100. Referring to FIGS. 2 and 4, the cavity 98, 100 extends along a guide vane axis 102 through the inner platform segment 94, the outer platform segment 96 and the respective guide vane 82.

Referring to FIG. 4, one or more of the vane arrangement segments 92 may each be configured as a unitary body. The guide vane 82, for example, may be cast, machined, milled and/or otherwise formed integral with the inner platform segment 94 and the outer platform segment 96. The present invention, however, is not limited to any particular vane arrangement segment configurations or formation techniques.

Figure 5:
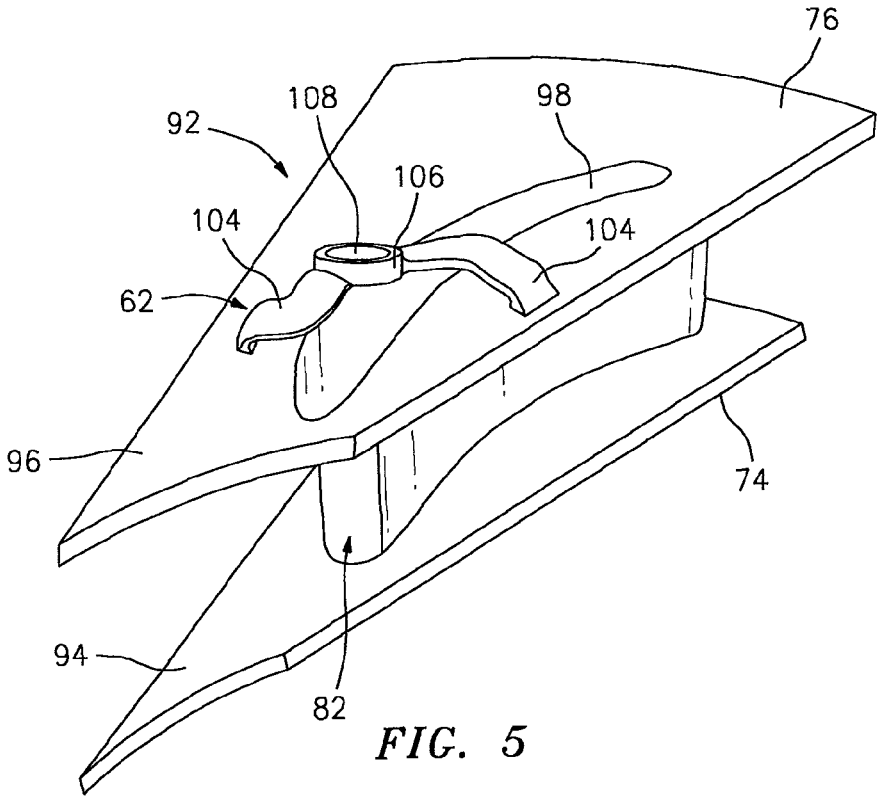
FIG. 5 is a perspective illustration of the vane arrangement segment of FIG. 4 configured with a mounting bracket.

Referring to FIGS. 2 and 5, one or more of the mounting brackets 62 each includes one or more support legs 104 and a support sleeve 106. The sleeve 106 may be configured as an annular sleeve body. The sleeve 106 includes a bore 108, which is defined by and extends through the sleeve 106 along the guide vane axis 102.

Figure 6:
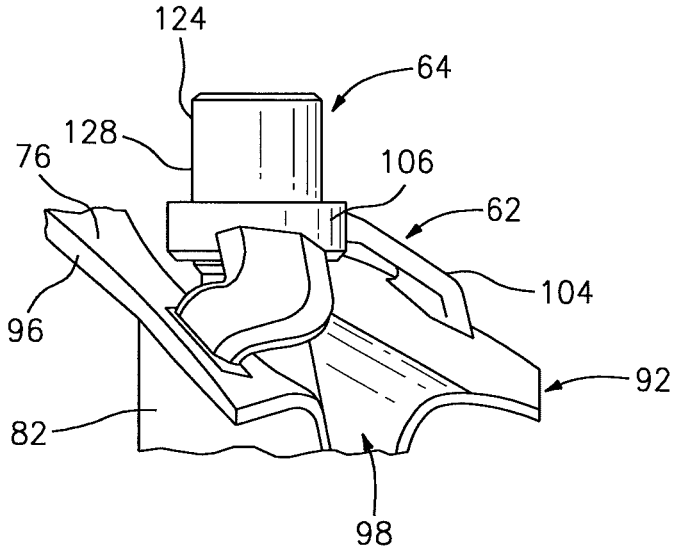
FIG. 6 is a partial perspective illustration of the vane arrangement segment and the mounting bracket of FIG. 5 configured with a portion of a strut.
Figure 7:
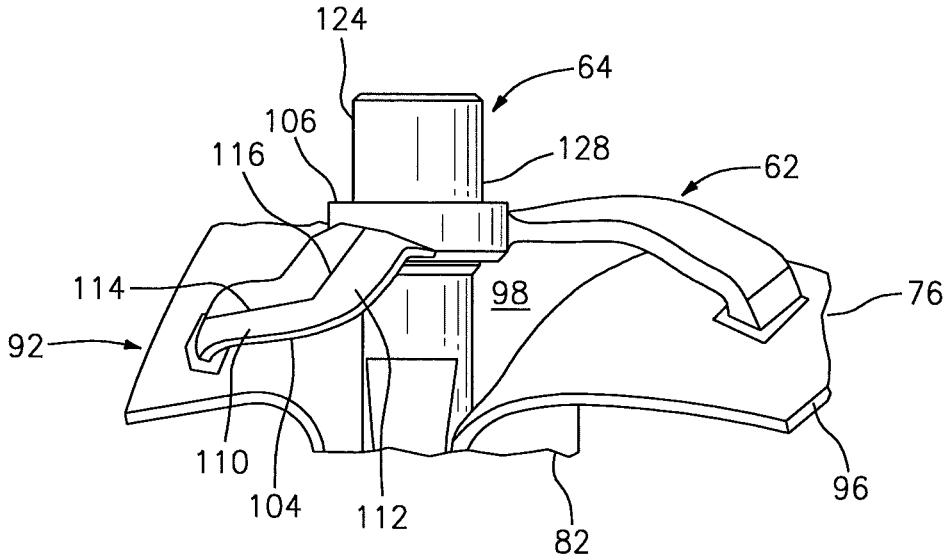
FIG. 7 is another partial perspective illustration of the vane arrangement segment, the mounting bracket and the strut of FIG. 6.

Referring to FIGS. 5 to 7, the support legs 104 are arranged on opposing sides of the support sleeve 106. The support legs 104 connect the support sleeve 106 to the vane arrangement segments 92 at (e.g., on, adjacent or proximate) the arrangement outer side 76. The respective mounting bracket 62, for example, may be formed integral with the outer platform segment 96 and, thus, the vane arrangement segment 92. Alternatively, the respective mounting bracket 62 may be configured discrete from the vane arrangement 60, and one or more of the support legs 104 may each be mechanically fastened, welded, brazed, adhered and/or otherwise bonded to the vane arrangement segment 92.

Referring to FIG. 7, one or more of the support legs 104 each includes a longitudinal first portion 110 and a longitudinal second portion 112. The first portion 110 is arranged and extends laterally between the vane arrangement segment 92 and the second portion 112. The first portion 110 has a chord 114 that is angled relative to a chord 116 of the second portion 112 by an offset angle. Alternatively, the first portion 110 may be configured substantially parallel and inline with the section portion 112. The first portion 110 is connected to the vane arrangement segment 92. The second portion 112 is connected to the support sleeve 106.

Figure 8:
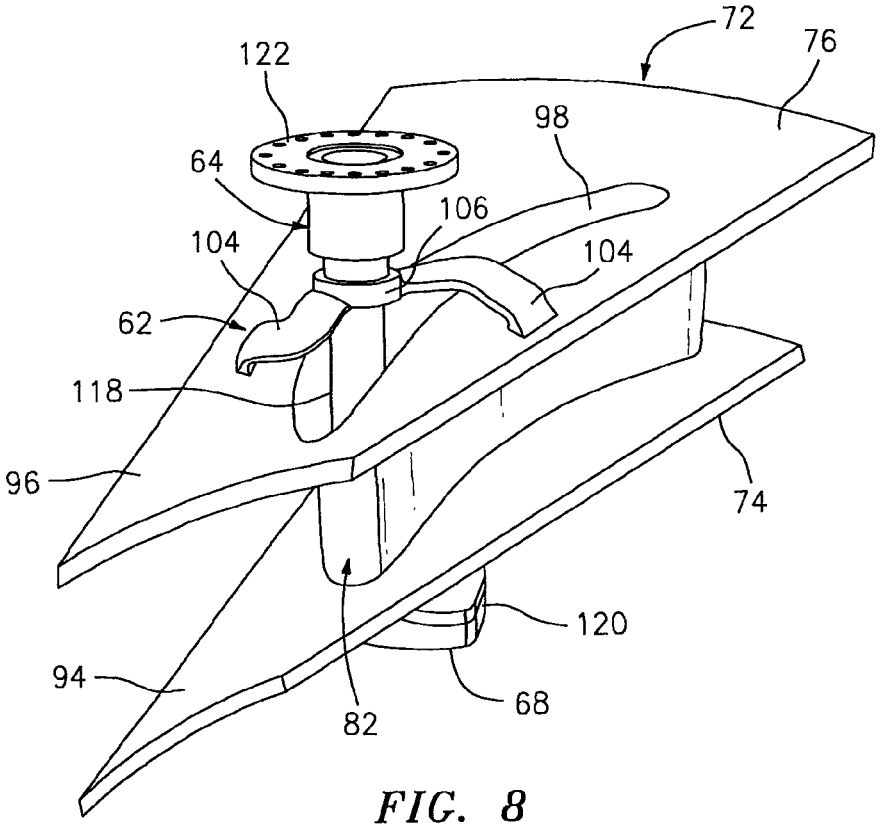
FIG. 8 is a perspective illustration of the vane arrangement segment and the mounting bracket of FIG. 5 configured with a strut.

Referring to FIGS. 2 and 8, one or more of the support struts 64 are each configured as a hollow I-rod. One or more of the support struts 64 each include, for example, a tie rod 118, an inner mount 120 and an outer mount 122. The tie rod 118 is arranged radially between and connected to the inner mount 120 and the outer mount 122. The tie rod 118, for example, is formed integral with the inner mount 120, which is configured as a mounting plate. The outer mount 122 is configured as a flanged nut, which mates with an outer threaded portion 124 of the tie rod 118.

Each of the support struts 64 is arranged with a respective one of the vane arrangement segments 92 having one of the cavities 98 (see FIG. 3). Alternatively or additionally, one or more of the support struts 64 may also be respectively arranged with one or more of the vane arrangement segments 94 having the cavities 100. Referring again to FIGS. 2 and 8, the tie rod 118 extends radially through the cavity 98. The inner mount 120 is attached to the engine component 68 with, for example, one or more fasteners (not shown). The outer mount 122 extends radially through an aperture 126 in the second engine case 38 to the tie rod 118. In this manner, the respective support strut 64 structurally couples and may transfer radial loads between the engine component 68 and the second engine case 38.

The tie rod 118 also extends radially through the support sleeve 106. A relatively smooth portion 128 of the tie rod 118 engages the support sleeve 106. The tie rod portion 128, for example, slidably contacts an inner surface of the support sleeve 106. In this manner, the respective mounting bracket 62 structurally couples the vane arrangement segment 92 and the vane arrangement 60 to the support struts 64. Each of the mounting brackets 62 may, for example, constrain (e.g., substantially prevent or otherwise reduce) axial and/or lateral movement of the respective vane arrangement segment 92 relative to the respective strut 64. The support sleeve 106 and the respective vane arrangement segment 92, however, may slide along the tie rod portion 128 to accommodate thermal expansion and contraction of the vane arrangement 60 during engine 20 operation. Alternatively, one or more of the mounting brackets 62 may each be fixed to the support strut 64.

The vane arrangement 60 may have various configurations other than that described above and/or illustrated in the drawings. For example, the inner platform and/or the outer platform may each be configured as a unitary platform hoop; e.g., without the respective platform segments. One or more of the guide vanes may each be formed integral with one or both of the platform hoops. Alternatively, one or more of the guide vanes may each be attached (e.g., mechanically fastened, welded, brazed, adhered and/or otherwise bonded) to one or both of the platform hoops. The present invention therefore is not limited to any particular vane arrangement configurations.

Figure 9:
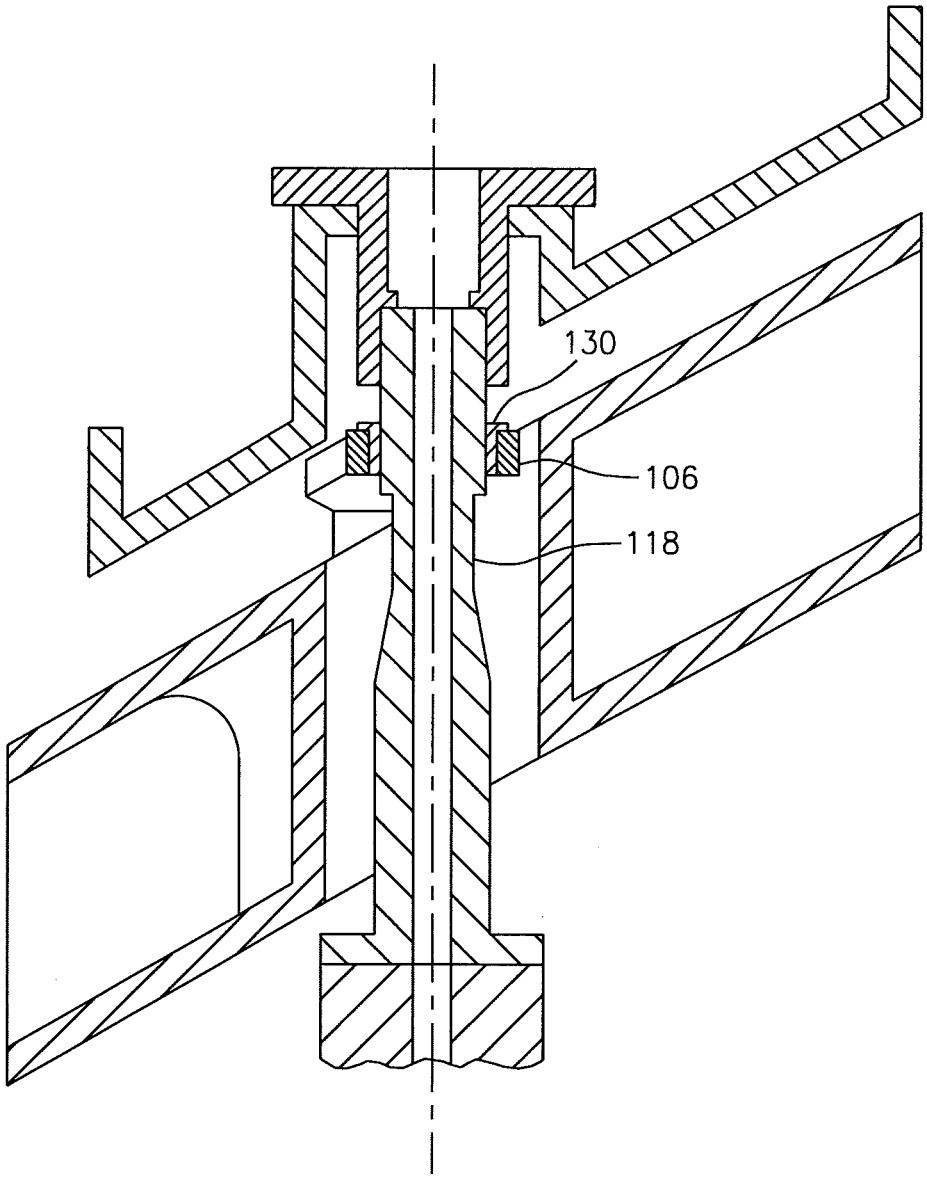
FIG. 9 is a partial side-sectional illustration of another turbine engine assembly for the engine of FIG. 1.

One or more of the mounting brackets 62 may each have various configurations other than that described above and/or illustrated in the drawings. For example, referring to FIG. 9, a bushing 130 may be arranged between the support sleeve 106 and the tie rod 118. One or more of the support legs may each be substantially linear or arcuate. While the drawings illustrate the support legs as extending generally laterally between the vane arrangement segment and the sleeve, one or more of the support legs may alternatively extend generally axially between the vane arrangement segment and the sleeve. The present invention therefore is not limited to any particular mounting bracket configurations.

One or more of the support struts 64 may each have various configurations other than that described above and/or illustrated in the drawings. One or more of the support struts, for example, may each include a solid tie-rod or any other type of structural support. The inner mount may be configured as a threaded shaft that mates with (e.g., threads into) the engine component. The present invention therefore is not limited to any particular strut configurations.

The terms "upstream", "downstream", "inner" and "outer" are used to orientate the components of the turbine engine assembly 58 described above relative to the turbine engine 20 and its axis 22. A person of skill in the art will recognize, however, one or more of these components may be utilized in other orientations than those described above. One or more of the mounting brackets, for example, may be located at the inner side of the vane arrangement. The present invention therefore is not limited to any particular spatial orientations.

The turbine engine assembly 58 may be configured in or between various sections of the engine 20 other than the turbine section 31. The turbine engine assembly 58 may also be included in various turbine engines other than the one described above. The turbine engine assembly, for example, may be included in a geared turbine engine where a gear train connects one or more shafts to one or more rotors in a fan section, a compressor section and/or any other engine section. Alternatively, the turbine engine assembly may be included in a turbine engine configured without a gear train. The turbine engine assembly may be included in a geared or non-geared turbine engine configured with a single spool, with two spools (e.g., see FIG. 1), or with more than two spools. The turbine engine may be configured as a turbofan engine, a turbojet engine, a propfan engine, or any other type of turbine engine. The present invention therefore is not limited to any particular types or configurations of turbine engines, or locations within a turbine engine.

While various embodiments of the present invention have been disclosed, it will be apparent to those of ordinary skill in the art that many more embodiments and implementations are possible within the scope of the invention. For example, the present invention as described herein includes several aspects and embodiments that include particular features. Although these features may be described individually, it is within the scope of the present invention that some or all of these features may be combined within any one of the aspects and remain within the scope of the invention. Accordingly, the present invention is not to be restricted except in light of the attached claims and their equivalents.

What is claimed is:

1. A turbine engine assembly with an axis, the assembly comprising:

a vane arrangement segment including a first platform segment, a second platform segment and a guide vane that extends radially between the first and the second platform segments, the guide vane connected to the first and the second platform segments;

a mounting bracket connected to the vane arrangement segment; and a strut extending radially through the first platform segment, the second platform segment and the guide vane, and engaged with the mounting bracket;

wherein the mounting bracket attaches the vane arrangement segment to the strut; and wherein the mounting bracket is slidably engaged with the strut along an axis of the guide vane.

2. The assembly of claim 1, wherein the mounting bracket structurally couples the vane arrangement segment to the strut, and constrains at least axial and lateral movement of the vane arrangement segment relative to the strut.

3. The assembly of claim 1, wherein the vane arrangement segment includes an inner side and an outer side, the vane arrangement segment extends radially between the inner side and the outer side, and the mounting bracket is located at the outer side.

4. The assembly of claim 1, wherein the mounting bracket is connected to the second platfonit segment.

5. The assembly of claim 1, wherein the mounting bracket includes a sleeve and a leg;

the leg connects the sleeve to the vane arrangement segment; and the strut extends radially through the sleeve and the strut is engaged with the sleeve.

6. The assembly of claim 5, wherein the leg is one of a plurality of legs that each connects the sleeve to the vane arrangement segment.

7. The assembly of claim 5, wherein the leg includes a first portion and a second portion; and the first portion is arranged laterally between the vane arrangement segment and the second portion, and has a chord that is angled relative to a chord of the second portion.

8. The assembly of claim 1, wherein the strut comprises a tie rod.

9. The assembly of claim 1, further comprising:

an engine component; and an engine case;

wherein the strut structurally couples and transfers radial loads between the engine component and the engine case.

10. The assembly of claim 1, further comprising a bushing arranged between the strut and the mounting bracket.

11. A turbine engine assembly, comprising:

a vane arrangement segment including a first platform segment, a second platform segment, a guide vane and a cavity, wherein the guide vane extends along a guide vane axis between the first and the second platform segments, the guide vane is connected to the first and the second platform segments, and the cavity extends along the guide vane axis through the first platform segment, the second platform segment and the guide vane;

a mounting bracket including a leg and a sleeve, wherein the leg connects the sleeve to the vane arrangement segment, and the sleeve includes a bore that extends along the guide vane axis; and a strut extending through the first platform segment, the second platform segment and the guide vane, and the strut engaged with the sleeve, wherein the mounting bracket is slidably engaged with the strut along the guide vane axis.

12. The assembly of claim 11, wherein the vane arrangement segment includes an inner side and an outer side, the vane arrangement segment extends radially between the inner side and the outer side, and the mounting bracket is located at the outer side.

13. The assembly of claim 11, wherein the leg is connected to the second platform segment.

14. The assembly of claim 13, wherein the mounting bracket is formed integral with the second platform segment.

15. The assembly of claim 11, wherein the leg is one of a plurality of legs that each connects the sleeve to the vane arrangement segment.

16. The assembly of claim 11, wherein the leg includes a longitudinal first portion and a longitudinal second portion; and the first portion is arranged laterally between the vane arrangement segment and the second portion, and has a chord that is angled relative to a chord of the second portion.

17. The assembly of claim 11, wherein the mounting bracket attaches the vane arrangement segment to the strut.

18. A turbine engine assembly, comprising:

a guide vane arrangement including a first platform, a second platform and a plurality of guide vanes arranged circumferentially around an axis, wherein the plurality of guide vanes include a first guide vane that extends radially between the first platform and the second platform, and the first guide vane is connected to the first platform and the second platform;

a mounting bracket connected to the guide vane arrangement; and a strut extending radially through the first platform, the second platform and the first guide vane, and engaged with the mounting bracket;

wherein the mounting bracket attaches the guide vane arrangement to the strut; and wherein the mounting bracket is slidably engaged with the strut along the axis of the guide vane.

19. The assembly of claim 18, further comprising:

a second mounting bracket connected to the guide vane arrangement; and a second strut extending radially through the first platform, the second platform and a second guide vane included in the plurality of guide vanes;

wherein the second strut is engaged with the second mounting bracket, and the second mounting bracket attaches the guide vane arrangement to the second strut.

* * * * *